US006757504B2

(12) United States Patent
Amano

(10) Patent No.: US 6,757,504 B2
(45) Date of Patent: Jun. 29, 2004

(54) IMAGE FORMING APPARATUS

(75) Inventor: Kiyoshi Amano, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/084,429

(22) Filed: Feb. 28, 2002

(65) Prior Publication Data

US 2002/0127028 A1 Sep. 12, 2002

(30) Foreign Application Priority Data

Mar. 6, 2001 (JP) ..... 2001-061400

(51) Int. Cl.[7] ..... G03G 15/00
(52) U.S. Cl. ..... 399/88; 399/90
(58) Field of Search ..... 399/88, 90, 9, 399/11, 37, 107, 124

(56) References Cited

U.S. PATENT DOCUMENTS 6,032,004 A * 2/2000 Mirabella, Jr. et al. ..... 399/90

* cited by examiner

*Primary Examiner*—Hoang Ngo
(74) *Attorney, Agent, or Firm*—Fitzpatrick, Cella, Harper & Scinto

(57) ABSTRACT

An image forming apparatus has an interface portion for processing image information, a power supply device for supplying power to the interface portion, an opening/closing member capable of opening or closing relative to a main body of the apparatus, and a cover capable of opening the interface portion. In the image forming apparatus, the supply of the power from the power supply device to the interface portion is interrupted in an open state of the opening/closing member, and opening of the cover is prohibited in a close state of the opening/closing member.

14 Claims, 12 Drawing Sheets

IMAGE FORMING APPARATUS

BACKGROUND OF THE INVENTION

1. Field of the Invention

The present invention relates to image forming apparatus such as electrophotographic copiers, printers, word processors, facsimile machines, and so on for forming an image on a recording medium and, more particularly, to image forming apparatus equipped with an interface portion.

2. Description of the Related Art

A laser printer will be described below as an example of the image forming apparatus adopting the electrophotographic method and other recording methods.

FIG. 10 is a sectional view of a conventional laser beam printer, in which a recording material is conveyed almost horizontally from sheet feeding means 102 via transferring means 109 to fixing means 111, in which there are provided image forming means including a process cartridge 107 and others and light source means 105 including a laser scanner and others above the conveyed surface of the recording material, and which is constructed to feed the recording material, transfer a toner image onto the recording material, and thermally fix the toner image on the recording material.

Further, an electrical portion 115, in which power supplies for supplying AC, DC, and a high voltage for the apparatus and a control circuit for controlling the operation of the entire apparatus are integrated, is located in the lower part of the apparatus, and is connected through connectors 115*a* and 130*c* to an interface portion 130 for exchanging image signals with a computer or a network outside the apparatus through cable 132 so as to process or prepare image data. The image data processed and prepared at this interface portion 130 is sent via the electrical portion 115 to the light source means 105 connected through cable 118, whereby a photosensitive body 108 is exposed to scanning light modulated according to the image data to form a latent image thereon.

FIG. 11 is another sectional view obtained at another position in a direction normal to the plane of the drawing in FIG. 10 and shows a mounted state of an add-on such as a memory card 133 or the like on the interface portion 130. The user is allowed to open an access cover 134, provided on the back side of an exterior housing 113, around a hinge shaft 134*a* and load or unload the memory card 133 through an aperture 113*a* onto or out of the interface portion 130.

The user can also mount or dismount a process cartridge 107 by opening a door 116 around a shaft 116*a*, as shown in FIG. 12.

At this time, in order to protect the user, supply of power from the electrical portion 115 is halted in synchronism with the opening action of the door 116 by an unrepresented interlock mechanism.

However, the conventional image forming apparatus as shown in FIGS. 10 to 12 involves a possibility that the loading/unloading work of the add-on is carried out even during supply of power in the main body of the apparatus, so that the interface portion 130 can be electrically broken during the work. In order to avoid it, it was necessary to provide an interlock switch interlocked with the access cover, in addition to the interlock mechanism interlocked with the opening/closing action of the door 116, and this resulted in the disadvantage of cost increase.

There was another problem of poor workability, because the add-on such as the memory card 133 or the like had to be loaded or unloaded through the narrow aperture 113*a* onto or out of the interface portion 130.

SUMMARY OF THE INVENTION

A first object of the present invention is to provide image forming apparatus that can enhance the loading/unloading workability of the add-on, prevent the electrical breakage of the interface portion, and ensure the user's safety.

A second object of the present invention is to provide image forming apparatus comprising an interface portion for processing image information, power supply means for supplying power to the interface portion, an opening/closing member capable of opening or closing relative to a main body of the apparatus, and a cover capable of exposing the interface portion, wherein the supply of power from the power supply means to the interface portion is shut off in an open state of the opening/closing member and wherein opening of the cover is prohibited in a close state of the opening/closing member.

A third object of the present invention is to provide image forming apparatus comprising an interface portion for processing image information, power supply means for supplying power to the interface portion, an opening/closing member capable of opening or closing relative to a main body of the apparatus, and a cover capable of exposing the interface portion, wherein the supply of power from the power supply means to the interface portion is shut off in an open state of the opening/closing member and wherein closing of the opening/closing member is prohibited in an open state of the cover.

Further objects of the present invention will become apparent by the description which follows.

DETAILED DESCRIPTION OF THE PREFERRED EMBODIMENTS

The preferred embodiments of the present invention will be illustratively described below in detail with reference to the drawings. It is, however, noted that dimensions, materials, and shapes of the components, and their relative arrangement described in the embodiments can be properly modified according to configurations and various conditions of the apparatus to which the present invention is applied and that the scope of the invention is by no means intended to be limited to the embodiments below.

<First Embodiment>

Figure 1:
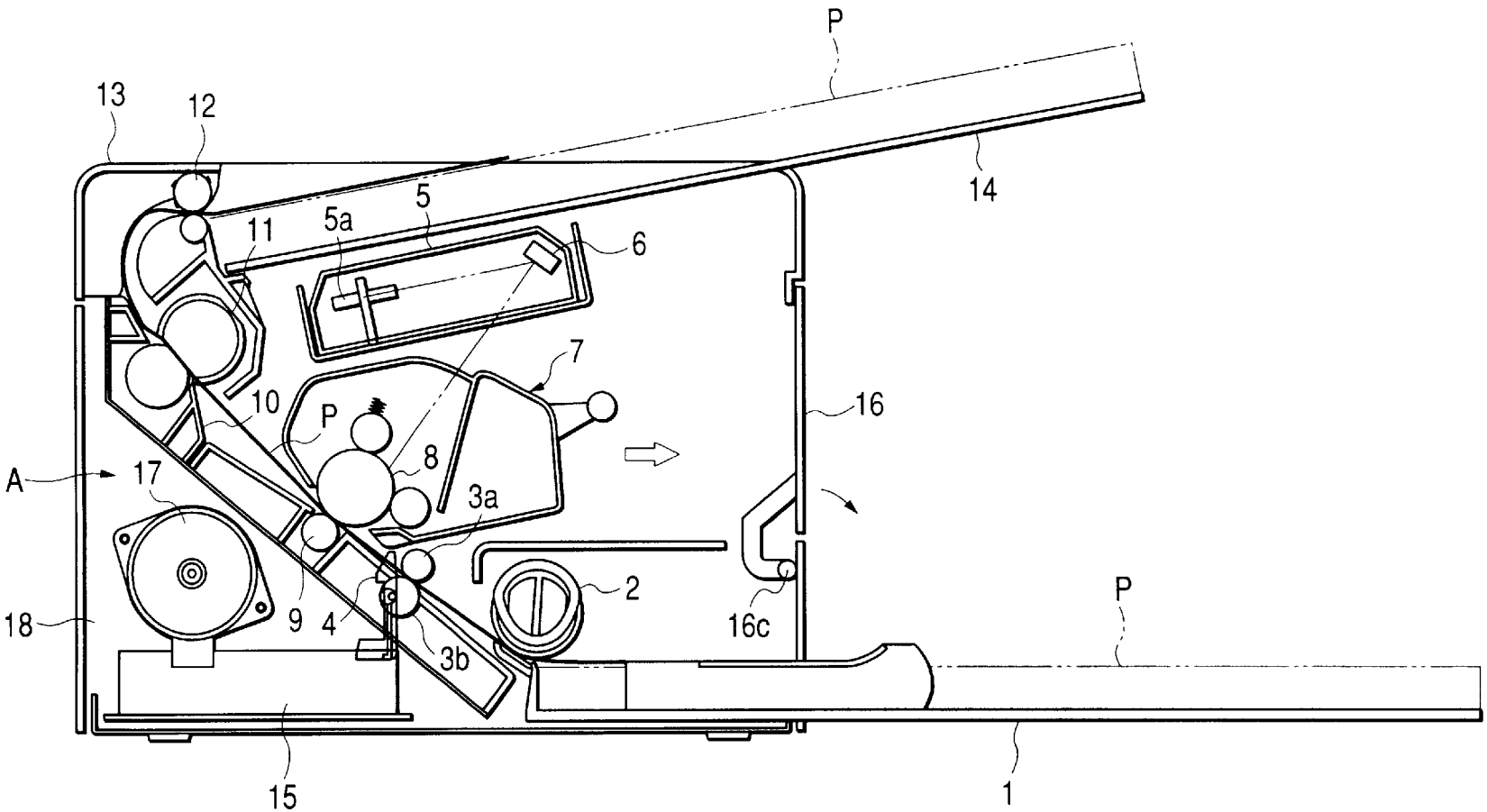
FIG. 1 is a sectional view of an image forming apparatus as Embodiment 1 of the present invention.

First described is the image forming apparatus to which the present invention can be applied. FIG. 1 is a sectional view of a laser beam printer as an embodiment of the image forming apparatus according to the present invention, and this laser beam printer adopts the electrophotographic method of scanning the photosensitive body with laser light to effect recording thereon.

In FIG. 1, reference numeral 1 designates a sheet cassette, which is freely mounted onto or dismounted from the main body of the apparatus. Recording materials P are stacked in the sheet cassette 1. The recording materials P are separated and fed one by one by a sheet feed roller 2 provided above and at the front end of the sheet cassette 1, to be conveyed to a transferring portion by conveying rollers 3*a*, 3*b*.

A registration sensor 4 functions to time the emission of laser scanner 5 as an exposure light source with the position of the leading end of the recording material P in order to start drawing an image from a predetermined position on the recording material P. Numeral 6 denotes a return mirror.

A process cartridge 7 is a cartridge consisting of a photosensitive body 8 as an image carrying body, and image forming means including a developing device, a cleaner, a charging roller, and so on. A transferring roller 9 is a roller for transferring a visualized image (toner image) on the photosensitive body 8, onto the recording material P, and a conveying guide 10 is a guide for guiding the recording material P after the transferring operation to a fixing device 11. The fixing device 11 heats and fixes the toner image on the recording material P. Then the recording material P with the toner image fixed thereon is discharged onto a sheet discharge tray 14 integrally formed with an exterior housing cover 13, by a sheet discharging roller 12. The cartridge can be, for example, one having the photosensitive body and the developing device, i.e., one having the photosensitive body and at least one image forming means.

Here the door 16 as an opening/closing member is rotatable about a shaft 16*c* and is arranged so that the process cartridge 7 can be mounted onto or dismounted from the main body of the apparatus by opening the door 16.

As shown in FIG. 1, the sheet feeding means consisting of the sheet cassette 1 and sheet feeding roller 2, the transferring means for transferring the toner image on the photosensitive body 8 onto the recording material P by the transferring roller 9, and the fixing device 11 for heating and fixing the toner image on the recording material P are arranged obliquely upward on an almost straight line with the fixing device 11 being located at the uppermost position.

A recording material P on the sheet cassette 1 is fed by the sheet feeding roller 2 and then is conveyed through the almost straight conveyance path up to the transferring portion by the conveying rollers 3*a*, 3*b*. After that, the photosensitive body 8 and the transferring roller 9 nip and convey the recording material P up to the fixing device 11 while transferring the toner image thereonto. Since the conveyance path of the recording sheet P during this period is almost straight, rubbing noise can be reduced between the recording material P and the conveying guide 10 during the conveyance of the recording material P and the recording material P can be conveyed stably, thereby enhancing reliability of conveyance of the recording material P.

Since the fixing device 11 is located at the uppermost position of the conveyance path of the recording material, heat generated from the fixing device 11 can be dissipated even during continuous printing through an unrepresented louver portion formed in the exterior housing cover 13 to the outside of the apparatus.

Since the process cartridge 7 and the laser scanner 5 are located below or at the side of the fixing device 11, they can always work to provide good output images, without being affected by the heat generated from the fixing device 11.

Further, the conveyance path of the recording material according to the present embodiment is approximately parallel or coincident with a diagonal line of the laser beam printer, which permits the various mechanisms to be effectively positioned and which also permits compactification of the apparatus.

As shown in FIG. 1, the laser scanner 5 is placed in right upward unit arrangement from a scanner polygon 5*a*. The most effective way to make the size of the laser beam printer as small as possible, is to guide the laser beam onto the photosensitive body 8 from a direction approximately normal to the conveyance path of the recording material from the sheet feeding means via the transferring means to the fixing means, as shown in FIG. 1. This configuration minimizes the dimensions of the depth and height of the laser beam printer.

In the configuration shown in FIG. 1, the process cartridge 7 can be mounted or dismounted in directions almost parallel to the directions of loading and unloading of the sheet cassette 1, and this permits the user to handle a jam in the main body of the apparatus or replace the process cartridge 7 all in the same directions, thus enhancing usability.

When the angle of incidence of the laser beam is set as described above in the present embodiment, a high degrees of freedom is given to the arrangement of the laser scanner 5, which enhances usability and facilitates solving the problem of a temperature increase in the apparatus.

A motor 17 as a driving source, as shown in FIG. 1, is directly mounted on an electroconductive frame 18 as part of the frame of the laser beam printer and is positioned below the conveyed surface of the recording material.

By positioning the motor 17 below the conveying portion of the recording material as described above, it becomes feasible to increase the size of the motor, as the motor changes from a stopping motor to a DC motor, etc., in order to get ready for high speed operation of the image forming apparatus. This makes it feasible to readily implement a speed increase, for example, from 10 ppm to 20 ppm.

Since the motor 17 is directly mounted on the conductive frame 18 of the laser beam printer, the heat generated from the motor 17 itself can be readily guided to the frame 18, which makes it feasible to enhance motor efficiency, facilitate grounding, and decrease the total cost.

Further, the motor 17 is arranged together with the electrical portion 15 below the conveying portion of the recording material and blades are provided on the motor shaft to make an air flow, whereby waste heat from the electrical portion 15 can be dissipated more efficiently.

The configuration employed herein is such that the electrical portion 15, which is the power supply means consisting of an AC power supply, a DC power supply, a high voltage power supply, and a control circuit for controlling the entire apparatus, is positioned below the conveyance path of the recording material extending obliquely upward from the sheet feeding means to the fixing means, as shown in FIG. 1, to secure a large space area in the electrical portion 15 from the sheet feeding portion to the fixing portion. This configuration secures the path of the air flow made by the heat generated from the electrical portion 15.

The heat generated from the fixing device 11 located above the electrical portion 15 is guided through the unrepresented louver portion provided in the exterior housing cover 13 to the outside of the apparatus. In this case, if a space is given between the back surface of the fixing device 11 and the exterior housing cover 13, the waste heat from the fixing device 11 can also make an air flow in this space.

Accordingly, when a large space is provided below the fixing device 11 to accommodate the electrical portion 15 and the space is provided on the back surface side of the fixing device 11 as described above, it becomes feasible to make the air flow for the waste heat from the electrical portion 15 to the fixing device 11, without a fan or the like for cooling, whereby heat accumulation can be prevented inside the main body of the apparatus, so as to prevent an increase of temperature in the apparatus.

Accordingly, it is feasible to realize a fanless configuration, thereby decreasing the cost, and reducing the noise of the laser printer because of the absence of fan noise.

In order to effectively use the space area below the obliquely upward conveyance path of the recording material from the sheet feeding means to the fixing means, the electrical portion 15 is constructed in an L-shaped layout consisting of a horizontal portion and a vertical portion, which can further enhance the efficiency of the electrical portion 15.

Specifically, components or devices serving as heat generating sources are arranged on the vertical surface side and components or devices generating relatively little heat are arranged on the horizontal surface side. This layout permits the waste heat from the electrical portion 15 to be dissipated more efficiently.

The opening/closing member, cover, and opening/closing detecting mechanism of the present invention will be described below in detail with reference to FIGS. 2 to 6.

Figure 2:
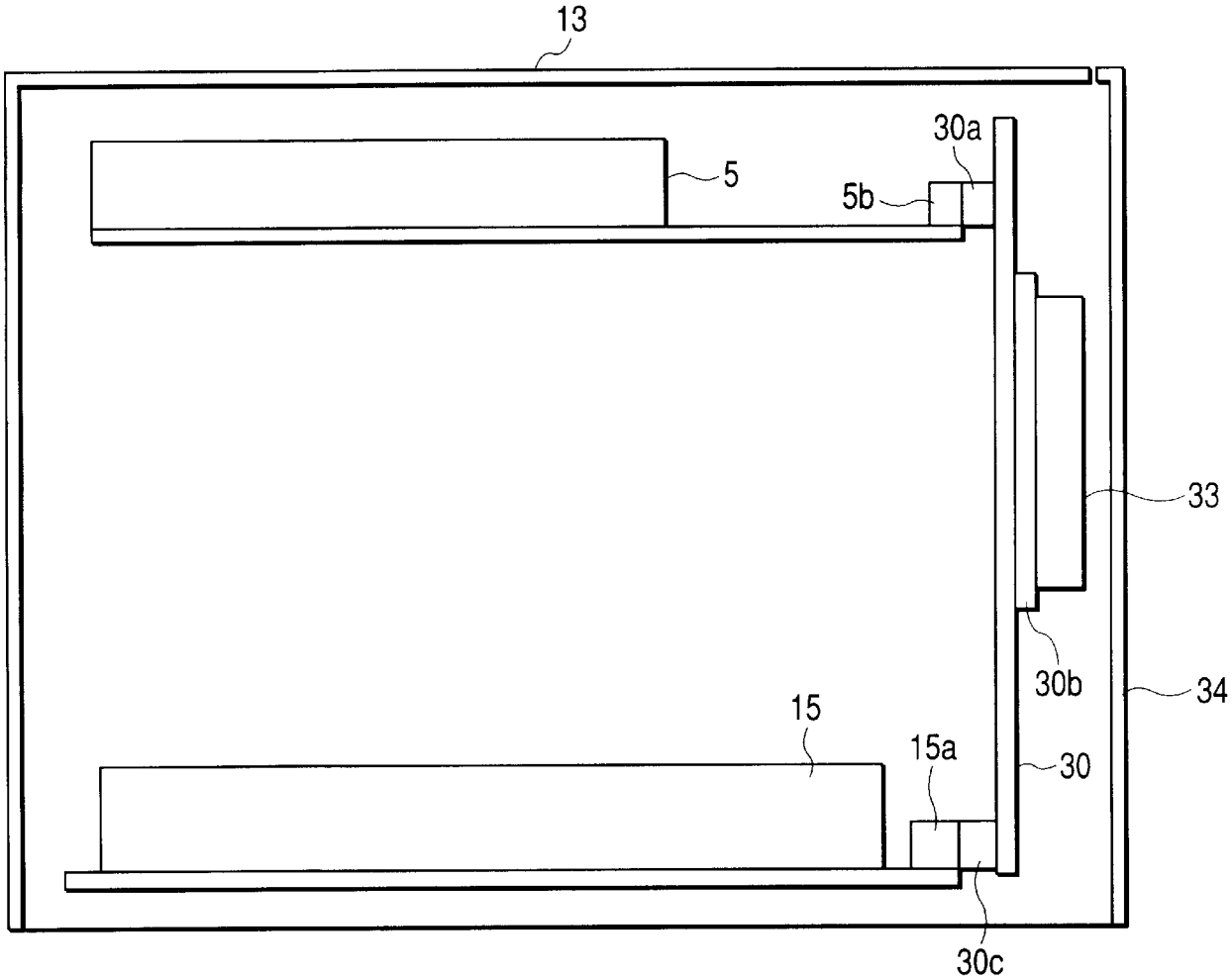
FIG. 2 is a sectional view of the image forming apparatus viewed from the direction of arrow A in FIG. 1.

FIG. 2 is a sectional view of the image forming apparatus viewed from the direction of arrow A in FIG. 1. As shown in FIG. 2, the interface portion 30, which exchanges image signals of image information with a computer or a network outside the apparatus and which performs the conversion process of the image data of image information and the preparation of image data as an expansion process, is vertically located to form a U-shape together with the electrical portion 15 and the laser scanner 5, is connected through a connector 30*a* and a connector 5*b* to the laser scanner 5, and is connected through a connector 30*c* and a connector 15*a* to the electrical portion 15 directly or by a harness such as an extremely short bundle cable, a flat cable, or the like.

A memory card 33 being a memory member as an add-on is inserted into a connector 30*b* on the interface portion 30, and a cover 34 covering the front surface of the memory card 33 is arranged to be detachable relative to the main body of the apparatus so as to expose the interface portion. The user can load or unload the memory card 33 by detaching the cover 34. Since the cover 34 covers the front surface of the interface portion 30, the whole of the memory card 33 is exposed so as to secure a work space, thus enhancing workability.

Figure 3:
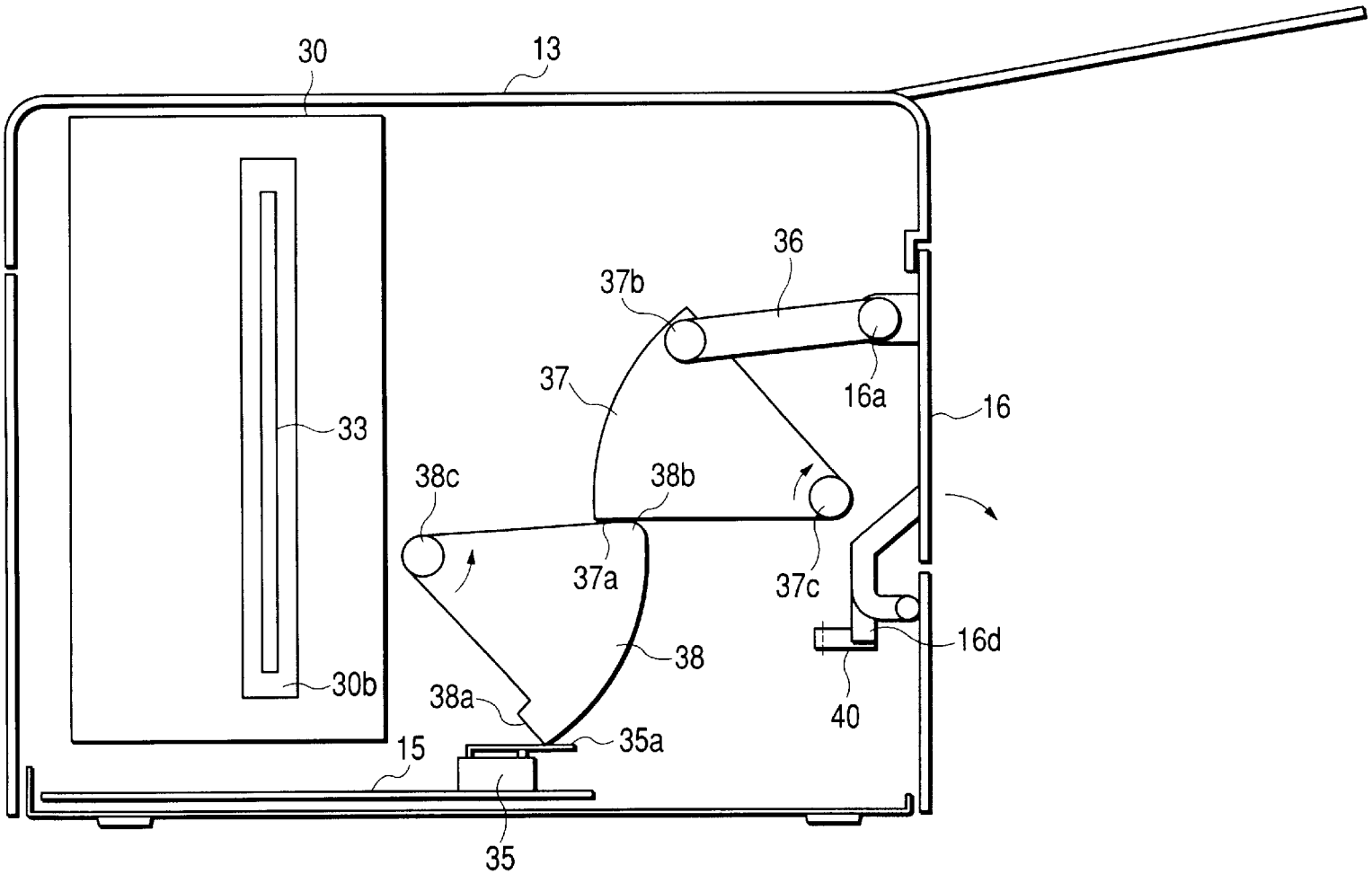
FIG. 3 is a sectional view showing the close state of the opening/closing member in the image forming apparatus as Embodiment 1 of the present invention.

On the other hand, as shown in FIG. 3, the electrical portion 15 is provided with a microswitch 35 as an interlock switch. One end of a rod 36 is rotatably coupled to the door 16 by a shaft 16*a*, and the other end of the rod 36 is rotatably coupled to a first lever 37 by a shaft 37*b*. The first lever 37 is rotatably coupled to the main body by a shaft 37*c*, an end 37*a* of the first lever 37 is in contact with one end 38*b* of a second lever 38 rotatably supported on the main body by a shaft 38*c*, and another end 38*a* of the second lever 38 pushes a lever 35*a* of the microswitch 35 down.

Figure 4:
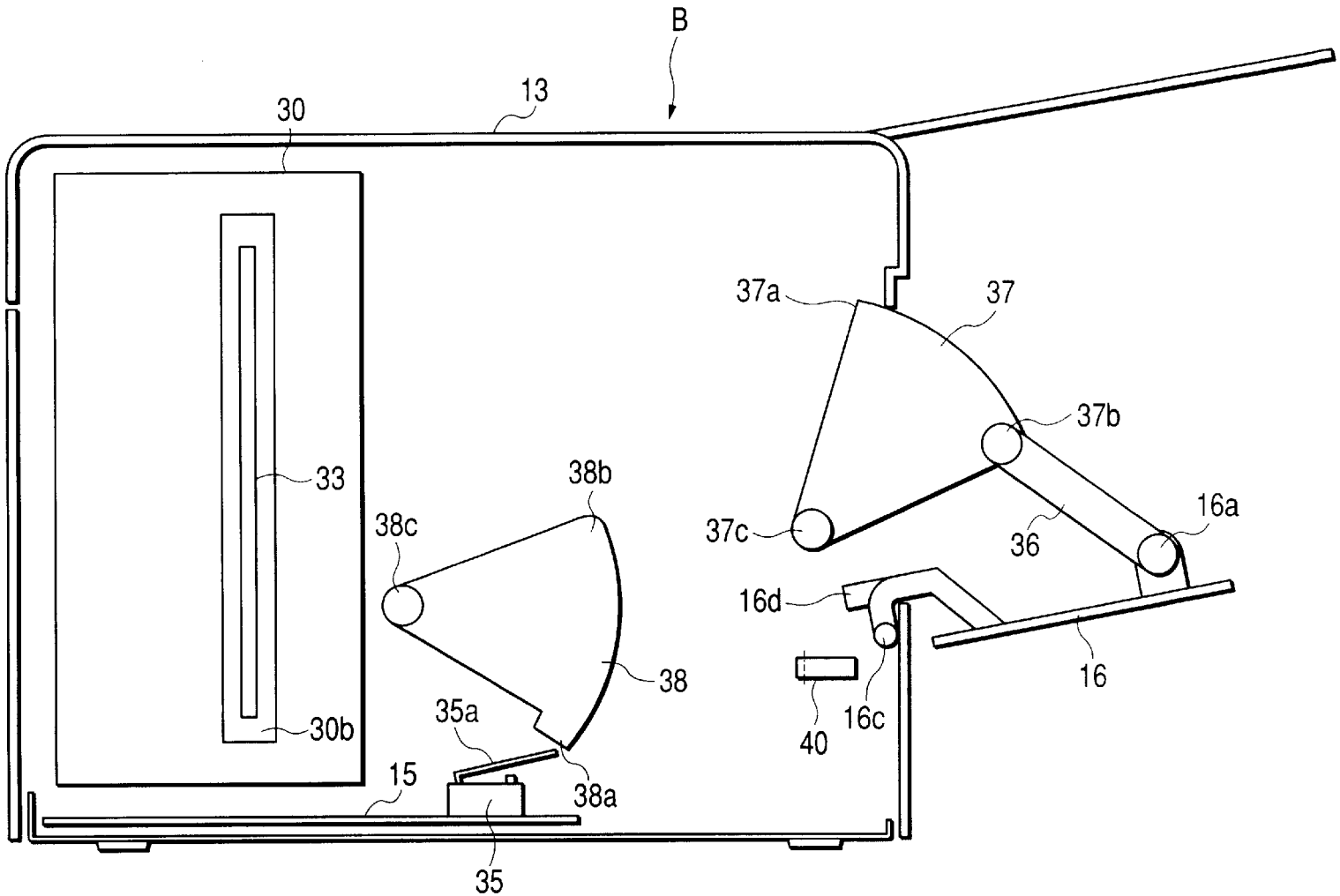
FIG. 4 is a sectional view showing the open state of the opening/closing member in the image forming apparatus as Embodiment 1 of the present invention.

As shown in FIG. 4, when the door 16 is opened for mounting or dismounting of the process cartridge 7, the rod 36 and the first lever 37 move to the right in linkage with the door 16, whereupon the first lever 37 and the second lever 38 are separated from each other. The reaction of the microswitch 35 pushes the second lever 38 up to disengage the interlock and thus interrupt the supply of power from the electrical portion 15 to each part, thereby ensuring the safety for the user during the mounting/dismounting work of the process cartridge 7.

Figure 5A:
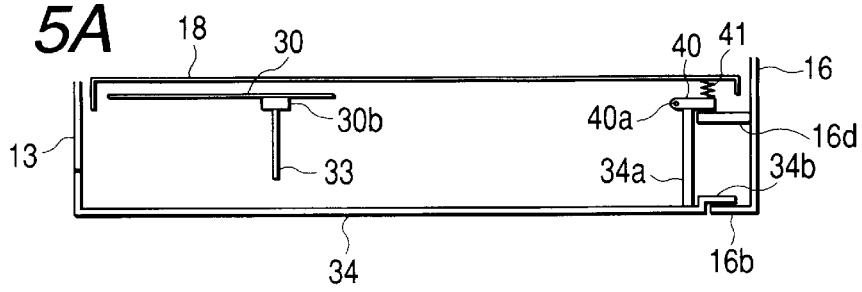
FIGS. 5A, 5B, 5C and 5D are sectional views showing the part around the interface portion in the image forming apparatus viewed from the direction of arrow B in FIG. 4.
Figure 5B:
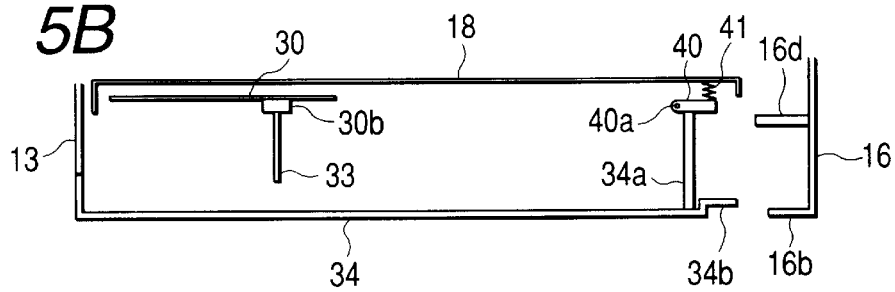
Figure 5C:
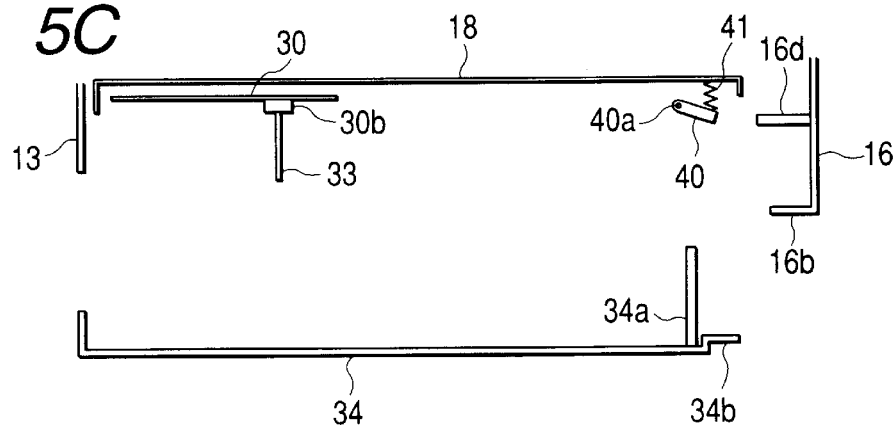
Figure 5D:
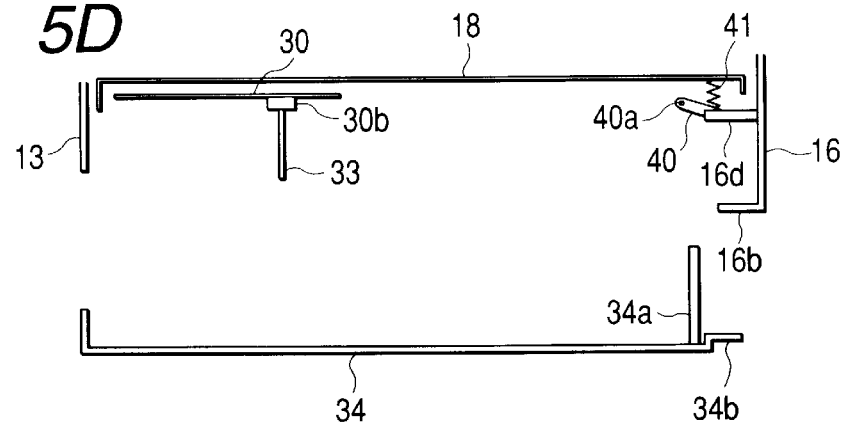

FIGS. 5A to 5D are sectional views of the part around the interface portion of the image forming apparatus viewed from the direction of arrow B in FIG. 4. As shown in FIG. 5A, the cover 34 cannot be dismounted in the close state of the door 16 where a bent portion 16*b* of the door 16 and an edge 34*b* of the cover 34 overlap each other. The cover 34 can be dismounted only in the open state of the door 16, as shown in FIGS. 5B and 5C. Namely, the interlock is disengaged during the dismounting work of the cover 34.

In the mounted state of the cover 34 an inside projection 34*a* pushes a stopper 40 as a stopper member inward and a hinge projection 16*d* of the door 16 can go into the outside space of the stopper 40 whereby the door 16 can be closed (see FIG. 5A).

Figure 6:
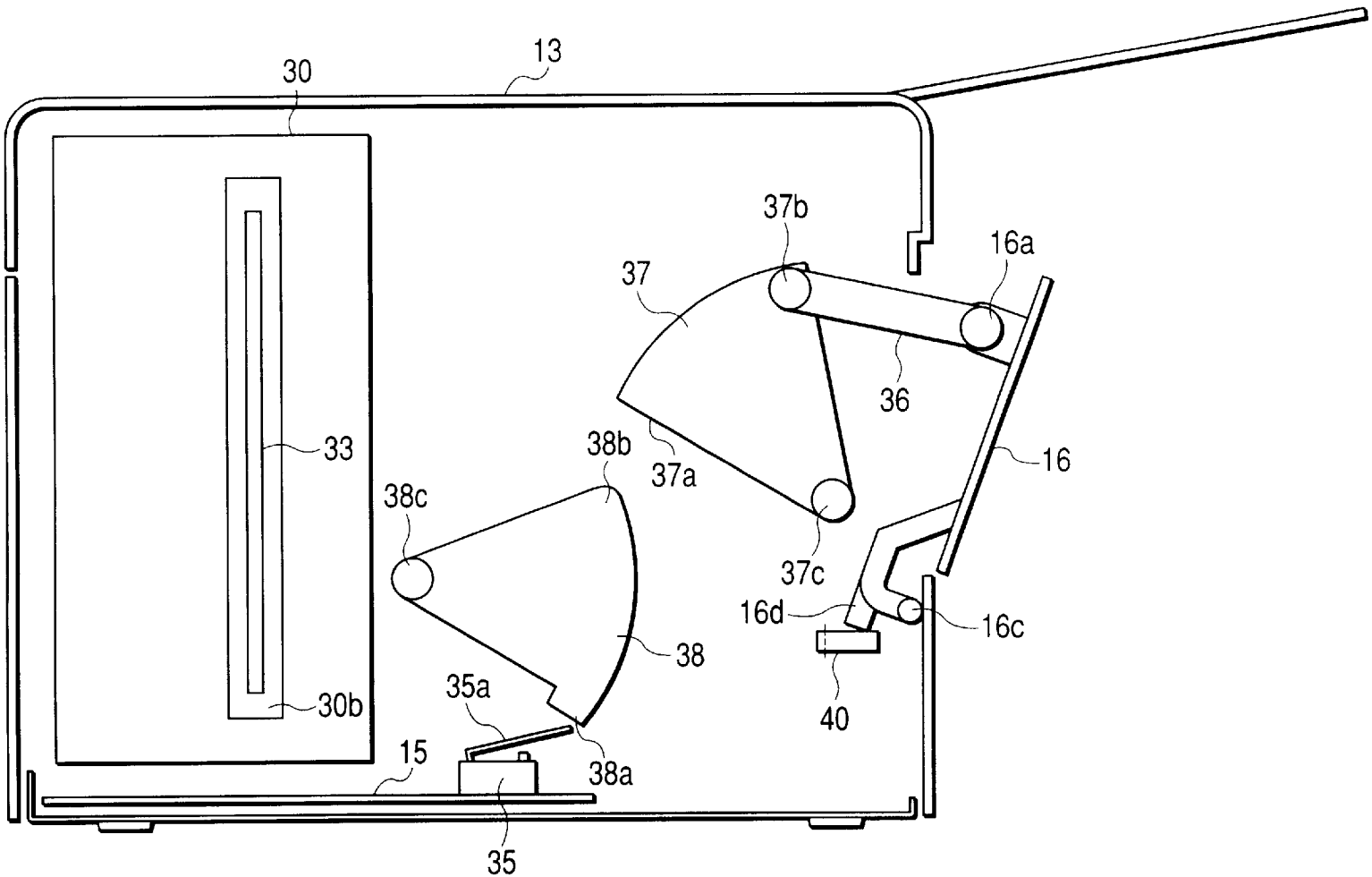
FIG. 6 is a sectional view showing a prohibited state of closing of the opening/closing member in the image forming apparatus as Embodiment 1 of the present invention.

While the cover 34 is dismounted, the stopper 40 is freed from the projection 34*a* of the cover 34 to be rotated around a shaft 40*a* by a spring 41 (see FIG. 5C). If the user tries to close the door 16 in this state, the stopper 40 will interfere with the projection 16*d* to hinder the door 16 from being completely closed (see FIG. 5D). For this reason, the first lever 37 will be kept from going into contact with the second lever 38, as shown in FIG. 6, so that no interlock will be established.

Accordingly, while the cover 34 is dismounted for loading or unloading the memory card 33 onto or out of the interface portion 30, the interlock is always disengaged to shut down the power supply to the interface portion 30, without a separate interlock mechanism in particular. This prevents the interface 30 from being electrically broken during the loading/unloading work of the memory card 33 and also ensures the safety for the user at the same time.

<Second Embodiment>

The image forming apparatus as Embodiment 2 of the present invention will be described below on the basis of FIGS. 7 to 9.

Figure 7:
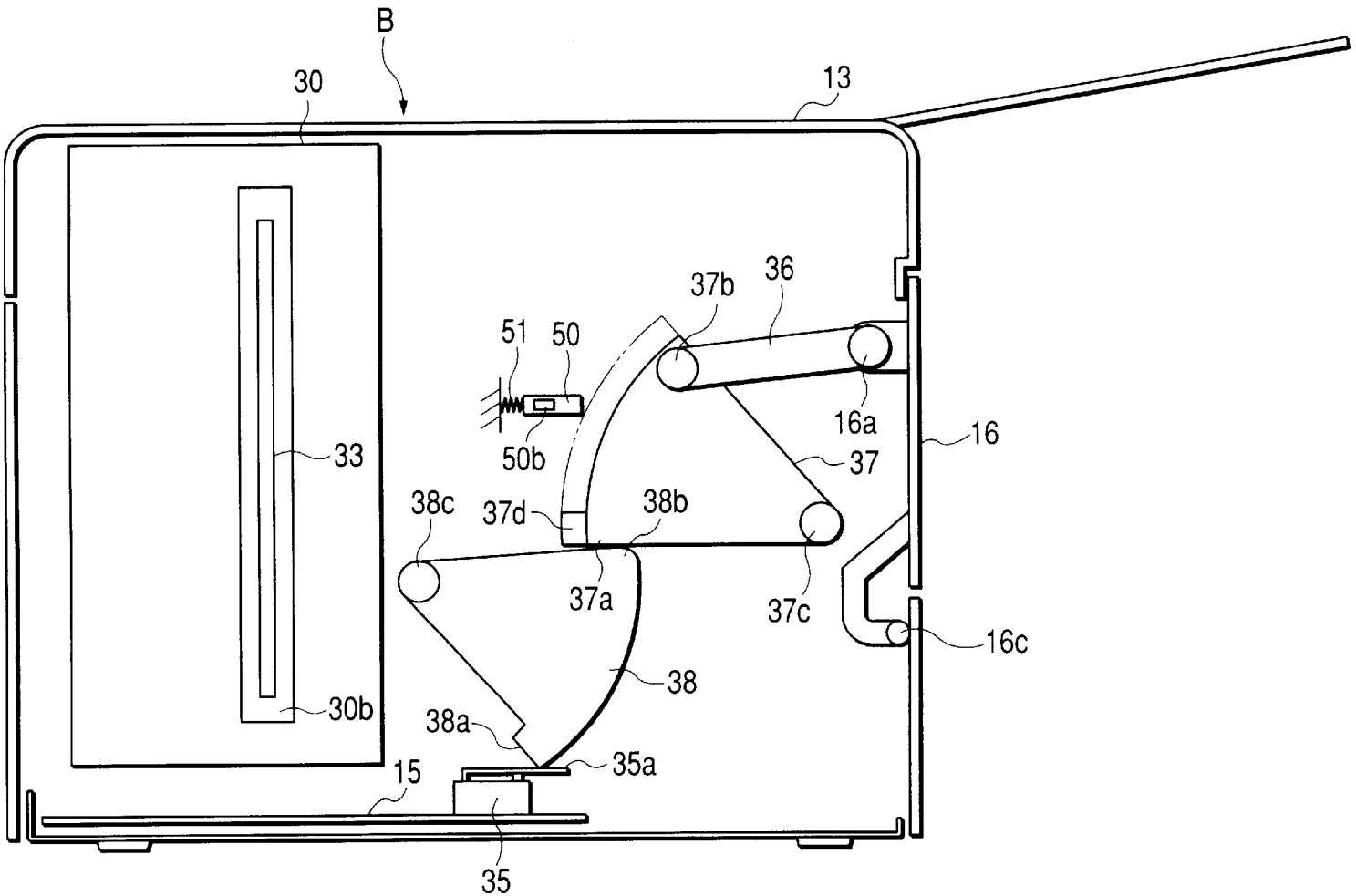
FIG. 7 is a sectional view showing the close state of the opening/closing member in another image forming apparatus as Embodiment 2 of the present invention.

In the present embodiment, as shown in FIG. 7, the first lever 37 is provided with a projection 37*d*, and a stopper 50 is located near an intermediate position to contact of the first lever 37 with the second lever 38.

Figure 8A:
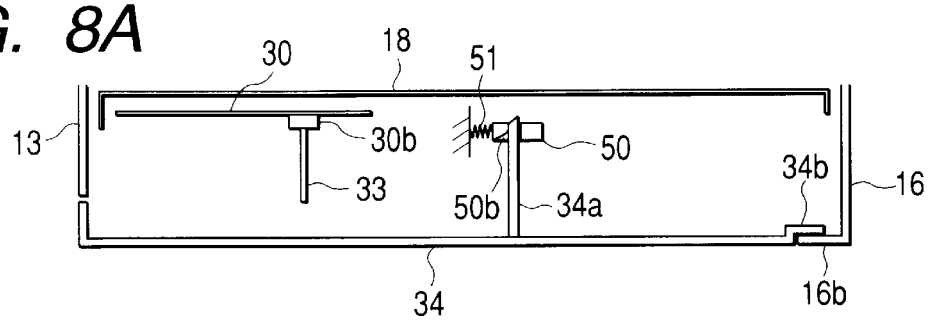
FIGS. 8A, 8B and 8C are sectional views showing the part around the interface portion in the image forming apparatus viewed from the direction of arrow B in FIG. 7.
Figure 8B:
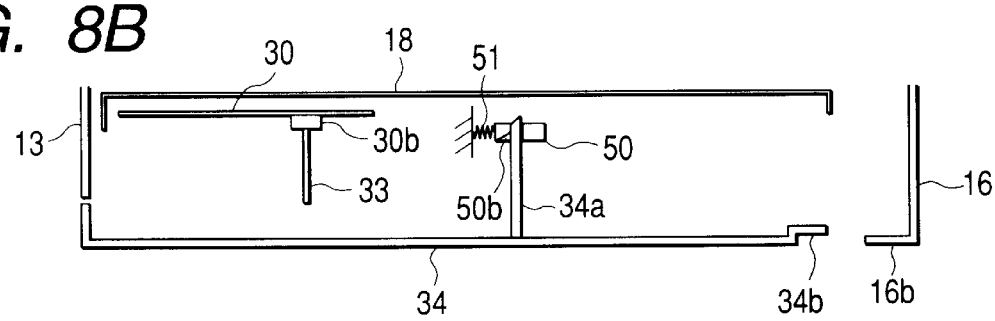
Figure 8C:
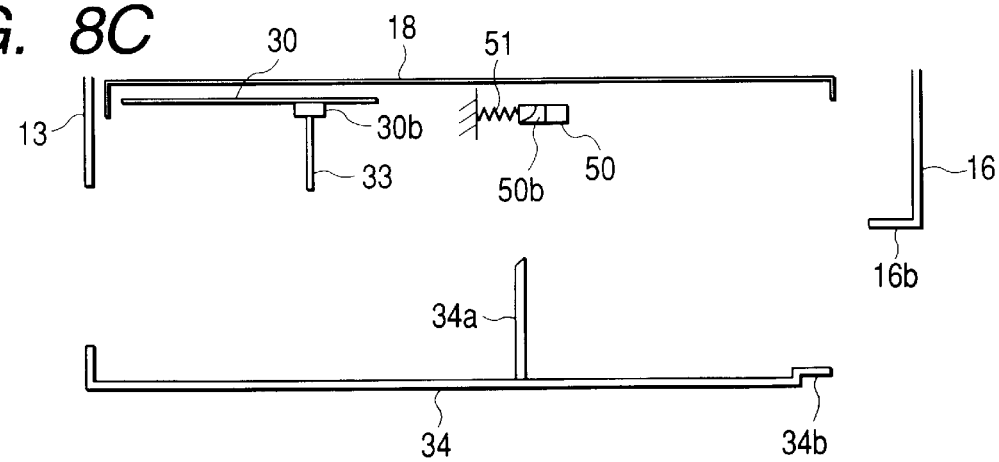
Figure 9:
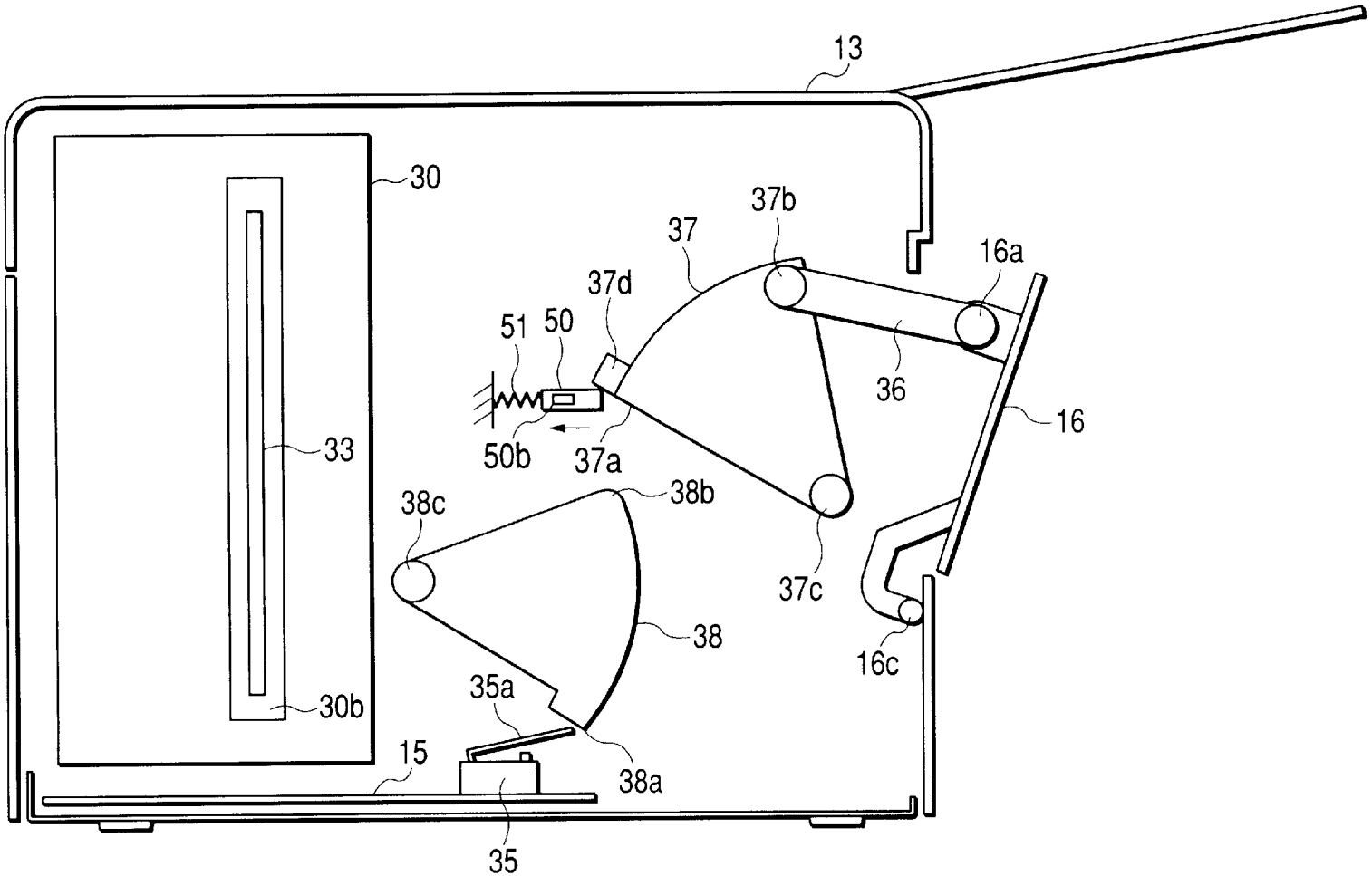
FIG. 9 is a sectional view showing the prohibited state of closing of the opening/closing member in the image forming apparatus as Embodiment 2 of the present invention.
Figure 10:
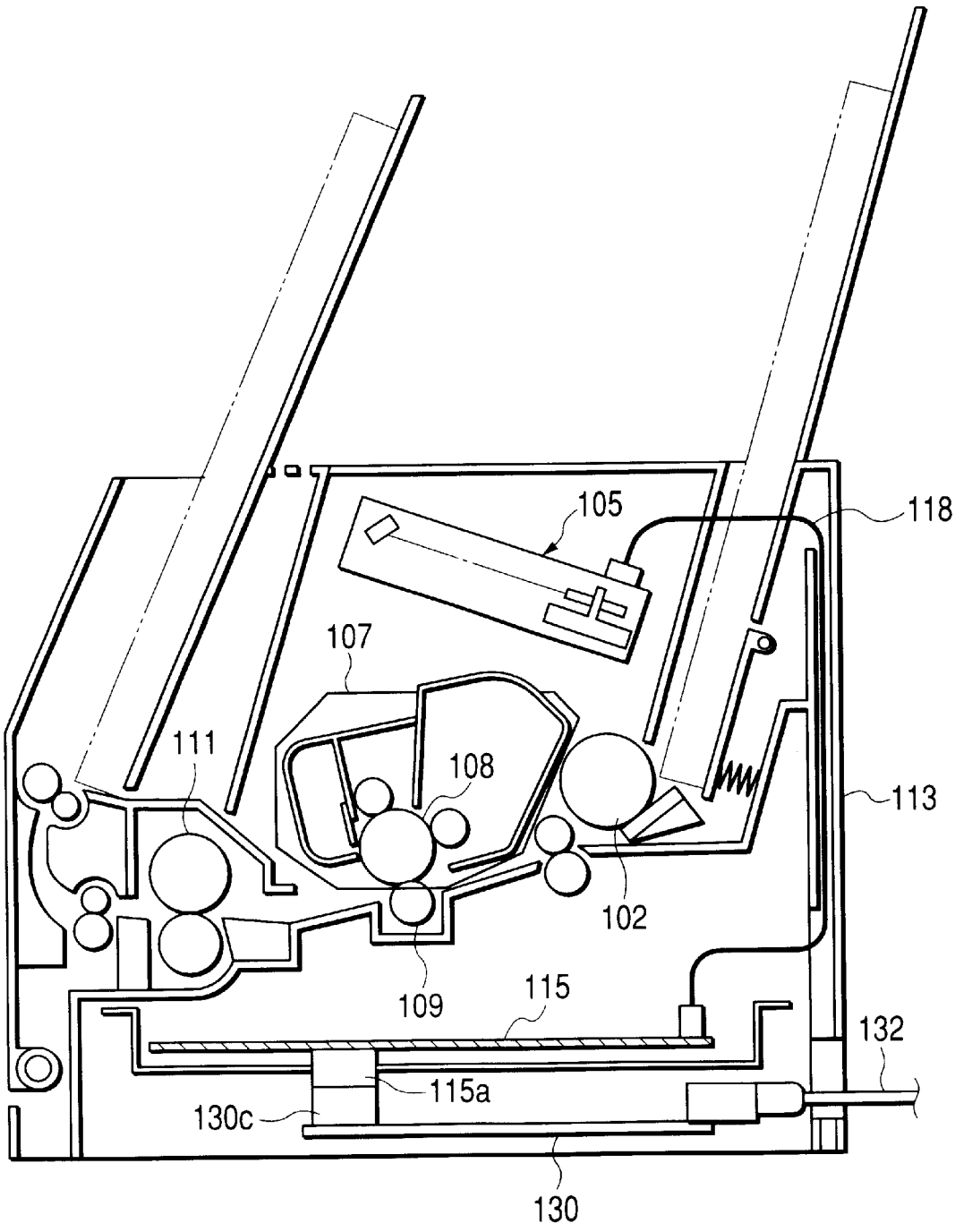
FIG. 10 is a sectional view of the conventional image forming apparatus (laser beam printer)
Figure 11:
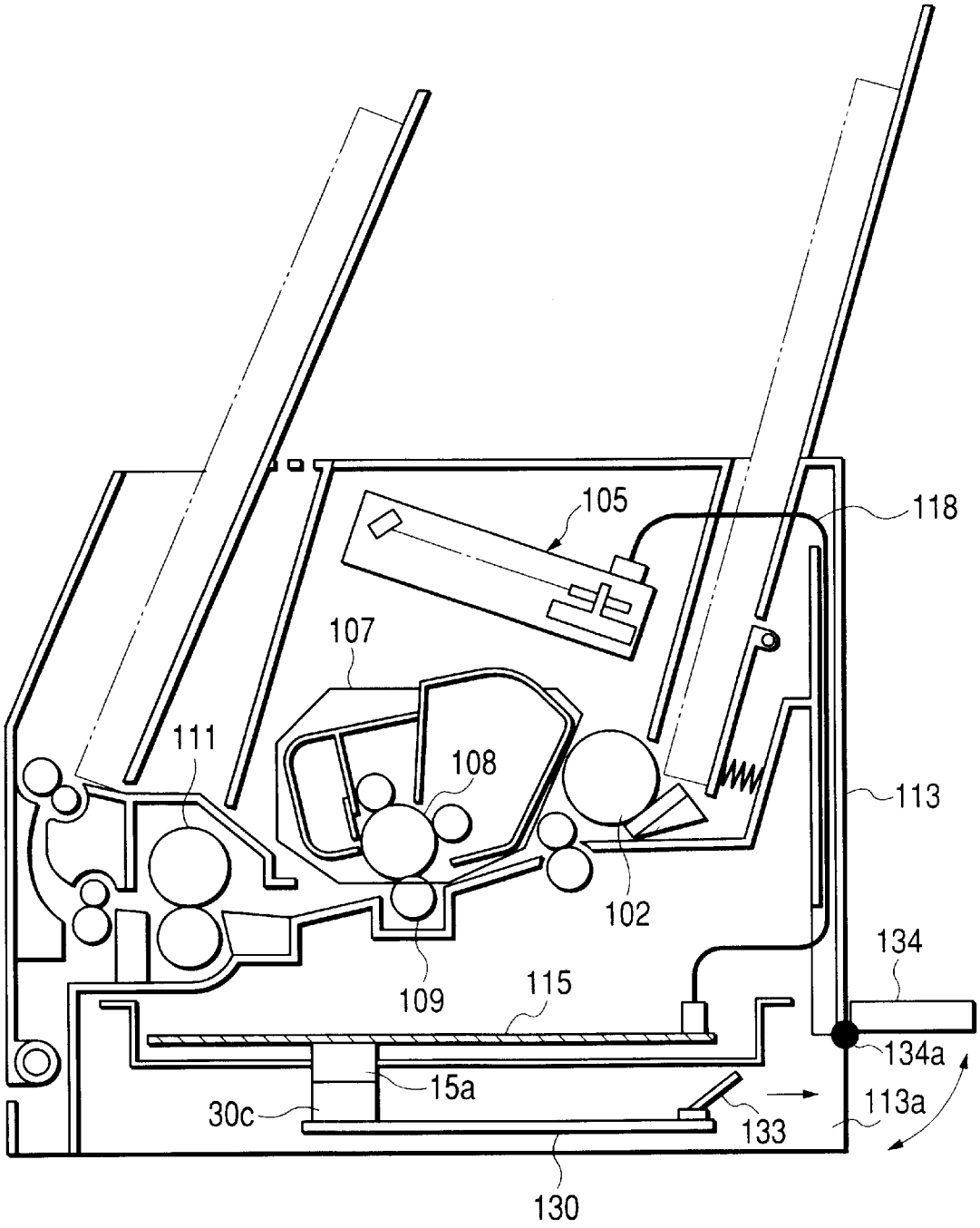
FIG. 11 is a sectional view of the conventional image forming apparatus (laser beam printer) including the access cover.
Figure 12:
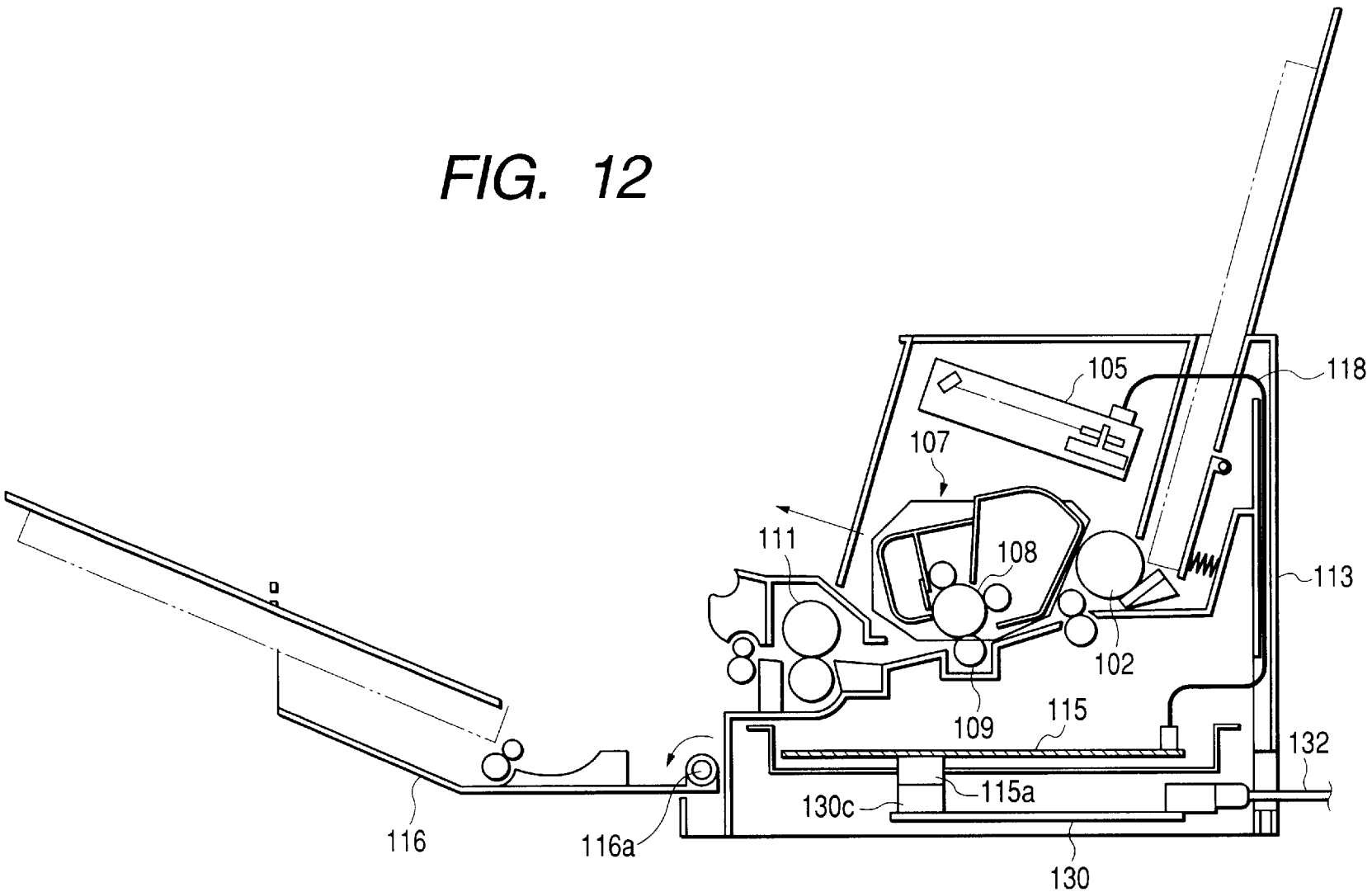
FIG. 12 is a sectional view of the conventional image forming apparatus (laser beam printer) showing the open state of the door.

FIGS. 8A to 8C are sectional views showing the part around the interface portion of the image forming apparatus viewed from the direction of arrow B in FIG. 7. In the mounted state of the cover 34 (FIG. 8A), a projection 34*a* engages a hole part 50*b* to shift the stopper 50 to the left so as to keep it outside a moving locus of the projection 37*d*, as shown in FIG. 7, so that the door 16 can be opened and closed.

Since the bent portion 16*b* of the door 16 and the edge 34*b* of the cover 34 overlap each other as in Embodiment 1 described previously, the cover 34 cannot be dismounted without opening the door 16. After the door 16 is opened (FIG. 8B), the cover 34 is dismounted, whereupon the stopper 50 is moved to the right by a spring 51 (FIG. 8C). If the user tries to close the door 16 in this state, the projection 37*d* will interfere with the stopper 50 to hinder the door 16 from being completely closed, as shown in FIG. 9, so that the first lever 37 will be kept from going into contact with the second lever 38. Therefore, no interlock will be established in that state.

In this structure, while the cover is dismounted for loading or unloading the add-on onto or out of the interface portion, the interlock is always disengaged to shut off the power supply to the interface portion without a separate interlock mechanism in particular, as in Embodiment 1, so that the interface portion is prevented from being electrically broken during the loading/unloading work of the add-on and the safety for the user is also ensured at the same time.

In the embodiments described heretofore, the member loaded onto or unloaded from the interface portion was the add-on, but the present invention can also be applied to members to be connected with the outside of the apparatus, e.g., a connector with a cable. It is, however, preferable to provide the cover with a notch or the like for connection of the cable.

In the embodiments of the present invention, the cover covering the interface portion was the one capable of being mounted onto or dismounted from the main body of the apparatus, but the present invention can also be applied to any configuration that can expose the interface portion, e.g., an opening/closing member that opens or closes around a certain portion.

What is claimed is:

1. An image forming apparatus comprising:

an interface portion including an image process part configured to process image information received from external equipment outside said apparatus;

power supply means for supplying power to said interface portion;

an opening/closing member capable of opening or closing to place said opening/closing member in an open or closed state, respectively, relative to a main body of said apparatus, wherein the supply of the power from said power supply means to said interface portion is interrupted in an open state of said opening/closing member; and a cover capable of opening said interface portion;

wherein opening of said cover is prohibited in a closed state of said opening/closing member.

2. An image forming apparatus according to claim 1, wherein said interface portion is capable of dismountably mounting an add-on.

3. An image forming apparatus according to claim 2, wherein said cover covers the entire part of said interface portion onto which the add-on is mounted or from which the add-on is dismounted, while facing the part of said interface portion onto which the add-on is mounted or from which the add-on is dismounted.

4. An image forming apparatus according to claim 2, wherein the add-on is a memory member.

5. An image forming apparatus according to claim 1, further comprising a cartridge having an image bearing body and at least one image forming means for forming an image on said image bearing body, wherein said cartridge can be mounted onto or dismounted from the main body of said apparatus in the open state of said opening/closing member.

6. An image forming apparatus according to claim 1, wherein in the closed state of said opening/closing member, a portion of said opening/closing member is located on the opening side of said cover to prohibit opening of said cover.

7. An image forming apparatus according to claim 1, further comprising a switch configured and positioned to interrupt the supply of the power from said power supply means to said interface portion.

8. An image forming apparatus comprising:

an interface portion including an image processing part configured to process image information received from external equipment outside said apparatus;

power supply means for supplying power to said interface portion;

an opening/closing member capable of opening or closing to place said opening/closing member in an open or closed state, respectively, relative to a main body of said apparatus, wherein the supply of the power from said power supply means to said interface portion is interrupted in an open state of said opening/closing member; and a cover capable of opening said interface portion;

wherein closing of said opening/closing member is prohibited in an open state of said cover.

9. An image forming apparatus according to claim 8, wherein said interface portion is capable of dismountably mounting an add-on.

10. An image forming apparatus according to claim 9, wherein said cover covers the entire part of said interface portion onto which the add-on is mounted or from which the add-on is dismounted, while facing the part of said interface portion onto which the add-on is mounted or from which the add-on is dismounted.

11. An image forming apparatus according to claim 9, wherein the add-on is a memory member.

12. An image forming apparatus according to claim 8, further comprising a cartridge having an image bearing body and at least one image forming means for forming an image on said image bearing body, wherein said cartridge can be mounted onto or dismounted from the main body of said apparatus in the open state of said opening/closing member.

13. An image forming apparatus according to claim 8, further comprising a stopper member configured and positioned to close said opening/closing member in the open state of said cover.

14. An image forming apparatus according to claim 8, wherein said power supply means includes a switch and wherein the supply of the power from said power supply means to said interface portion is interrupted by said switch.

* * * * *

UNITED STATES PATENT AND TRADEMARK OFFICE

CERTIFICATE OF CORRECTION

PATENT NO. : 6,757,504 B2
DATED : June 29, 2004
INVENTOR(S) : Kiyoshi Amano

It is certified that error appears in the above-identified patent and that said Letters Patent is hereby corrected as shown below:

Column 1,
Lines 6 and 10, “apparatus” should read -- apparatuses --.

Signed and Sealed this

Fourth Day of January, 2005

JON W. DUDAS
*Director of the United States Patent and Trademark Office*